United States Patent [19]

Swartz

[11] Patent Number: 4,915,392

[45] Date of Patent: Apr. 10, 1990

[54] BOARD GAME

[76] Inventor: Elmer L. Swartz, 9490 Harbor Greens Way, #C-203, Seminole, Fla. 34646

[21] Appl. No.: 202,415

[22] Filed: Jun. 6, 1988

[51] Int. Cl.[4] ..... A63F 3/02; A63F 3/00

[52] U.S. Cl. ..... 273/258; 273/288; 273/291

[58] Field of Search ..... 273/258, 248, 249, 250–254, 273/261, 242, 288, 291; D21/32, 34, 35, 36

[56] References Cited

U.S. PATENT DOCUMENTS

| | | | |
|---|---|---|---|
| 506,797 | 10/1893 | Schaaf et al. | 273/249 |
| 625,557 | 5/1899 | Jackson | 273/249 |
| 977,485 | 12/1910 | Tercy | 273/258 |
| 1,030,414 | 6/1912 | Mansfield | 273/249 |
| 1,242,969 | 10/1917 | Parker | 273/249 |
| 1,362,218 | 12/1920 | Beloin | 273/249 |
| 1,383,185 | 6/1921 | Boyd | 273/249 |
| 1,559,954 | 11/1925 | Gifford | 273/249 |
| 1,642,711 | 9/1927 | Alfonso | 273/249 |
| 2,843,385 | 7/1958 | Hausler | 273/258 |

*Primary Examiner*—Edward M. Coven
*Assistant Examiner*—Benjamin Layno

[57] ABSTRACT

The invention comprises new and unique apparatus for a game, the apparatus generally comprising a game board having concentric ring paths which intersect with radial paths. Each radial path is marked with a symbol and each concentric ring is marked with another symbol such that each playing position is identified by marking reference to the path symbol pieces are each marked with the same designation such that each playing piece corresponds to a playing position. To start play each player randomly takes out twenty pieces from a mixing bag. These pieces are then placed on the corresponding playing positions as designated by their marking reference. The players, in turn, then move their playing pieces towards the designated finishing spaces near the center of the board which have been removed from the playing area, and a means for mixing the playing pieces together.

8 Claims, 6 Drawing Sheets

BOARD GAME

BACKGROUND OF THE INVENTION

The invention relates to board games, particularly to those involving strategic moves towards one or more goals or objective positions.

A number of games have been invented to test a player's ability to strategically move against an opponent while considering a variety of alternatives available to the player.

Backgammon and Parchesi are examples of games wherein a player negotiates the movement of similar playing pieces about a playing board. The distance of movement along fixed paths of the playing pieces is dictated by a roll of the dice in these games. In the game of chess, players alternate turns but the path and distance of movement in two dimensions about a board varies depending upon the placing piece selected for movement. A variety of playing boards have been invented and patented to accomodate such games. For example U.S. Pat. No. 1,642,711, issued on Sept. 20, 1927, to E. C. Alfonso teaches a rectangular playing board with an outer series of cusps, one circle and an inner series of cusps. The circle and the cusps generally provide a variety of paths to the center of the circle. U.S. Pat. No. 1,559,954, issued on Nov. 3, 1925, to H. E. Gifford teaches a rectangular game board with one circular path which is connected with a cross path and a winning objective point in the center of the circle. U.S. Pat. No. 506,797, issued on Oct. 17, 1893, to W. Schaaf and G. A. Ritz teaches a generally circular playing area which further comprises a series of helical paths towards a center point. The possibilities for variations in such game board patterns is virtually infinite.

Other games have been structured about a given theme. "Monopoly", for example, teaches a rectangular playing board whose playing spaces correspond with the locales and neighborhoods of a ficticious community. The ficticious community further commprises a railroad system, utilities, and a jail. Variations of this game have been developed which capitalize on various different areas by renaming the board spaces to coincide with local neighborhoods. "Risk" is a game which is based upon the strategy involved in a potential world war. Players move various types of military members from country to country in an effort to achieve world domination.

An experience common to most people in present day societal life is that of encountering a selection of checkout lines in the supermarket. The one we select may be closed without warning or, perhaps after selecting a given line, one may open up several lines down causing us to be "out of position" to take advantage of the sudden time-saving windfall. To date, no game has been developed to capitalize upon this everyday experience, which is frequently frustrating and often calls on our full range of strategic resources.

SUMMARY OF THE INVENTION

The preferred embodiment of the present invention comprises a board game with a generally circular board, which is further adapted with at least 3 concentric rings, 48 starting positions, and 8 objective positions. These playing and objective spaces are also located within areas which are further defined by 8 U-shaped paths. The players' object in the game is to move the players' piece beginning from their assigned starting positions along the connected moving positions until reaching the apex of a U-shaped path, which is located on the inner concentric ring. From this point, the player may leave the circle, having "checked out" and the first player to "check out" the designated number of pieces is the winner of the game.

Several features of the game provide the opportunity to exercise strategy. First, there is a feature of the game which permits a player to "jump" and "capture" up to a certain designated number of opponents' pieces. This occurs when an opposing player is in an adjacent position and has an open space in another adjacent position. The use of "jumps" must be made in consideration of the number of "jumps" yet available to the player as compared with the importance of removing the particular opponent's piece.

Another strategy feature is provided by the apex of the U-shaped curve or "checkout" position. Upon reaching this position a player need not move off of the board, but may remain there in order to block the advance of opposing pieces. Also, each player is assigned a "blockade" piece which can prevent an opponent from moving through that space.

A certain amount of chance is injected into the game as the starting positions are determined by random draw. The game may be programmed to consume relatively longer or shorter periods of time by adjusting the number of beginning pieces, the number of "jumps" allowed, and by adjusting the number of "checkouts" required to win the game. Alternate versions of the game could be developed with more or less U-shaped paths about the playing area. A copy of a set of rules for playing the game is attached as Exhibit I.

It is an object of the invention to provide a game to resemble the experience of negotiating the checkout network of a supermarket.

It is a further object of the invention to provide a game which provides a player with an opportunity to compete with another player in one by one moves about a playing board towards certain objectives while having a variety of strategic alternatives to consider.

It is a further object of the invention to provide a game board and accessories enabling a person to play a game encompassing the previously described objects of the invention.

Other features and advantages of the present invention will be apparent from the following description in which the preferred embodiments have been set forth in conjunction with the accompanying drawings.

BRIEF DESCRIPTION OF THE DRAWINGS

FIG. 5 depicts a closeup of a storage area.

Exhibit I is a set of rules for playing the game "Checkout."

DETAILED DESCRIPTION OF THE PREFERRED EMBODIMENT

Figure 1:
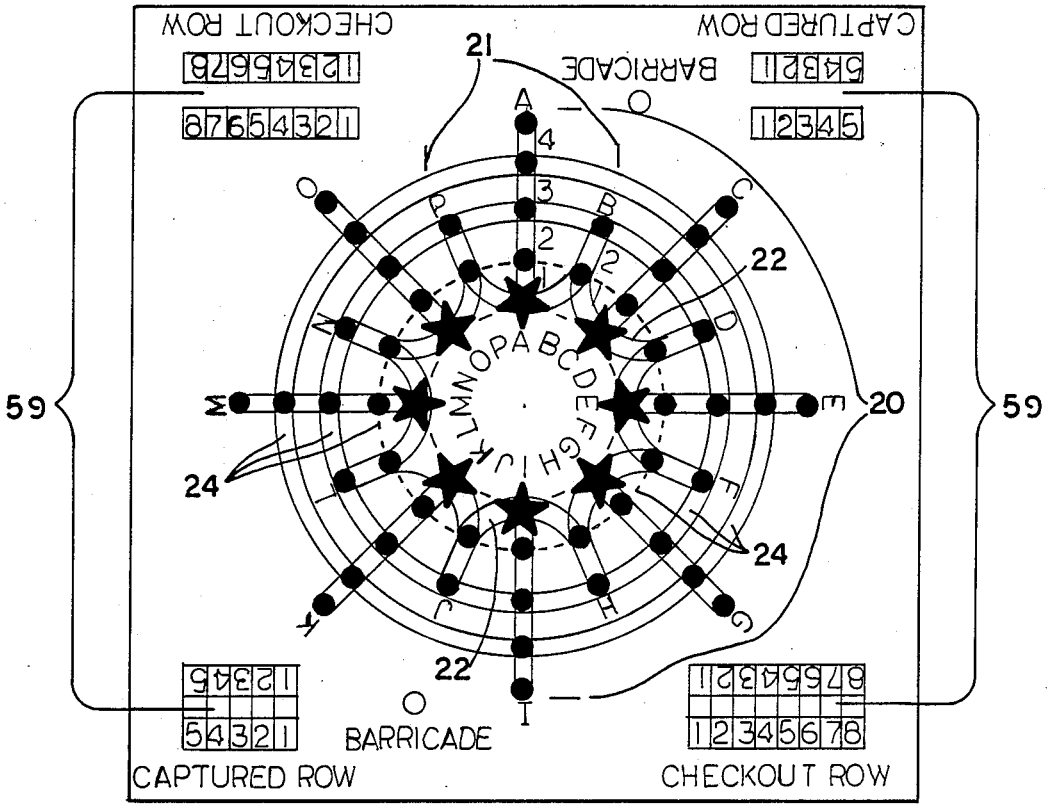
FIG. 1 is a drawing depicting the overall layout of the game showing a possible way of locating each element of the game.

In describing the preferred embodiment of the invention, reference will first be made to FIG. 1 which is a view of the entire playing board, which includes the playing area along with areas (41) for storing playing pieces, not in FIG. 1, which have been, for one reason or another, removed from the playing area (20). The playing area (20) comprises series of three concentric rings (24) and is circular in shape.

Figure 2:
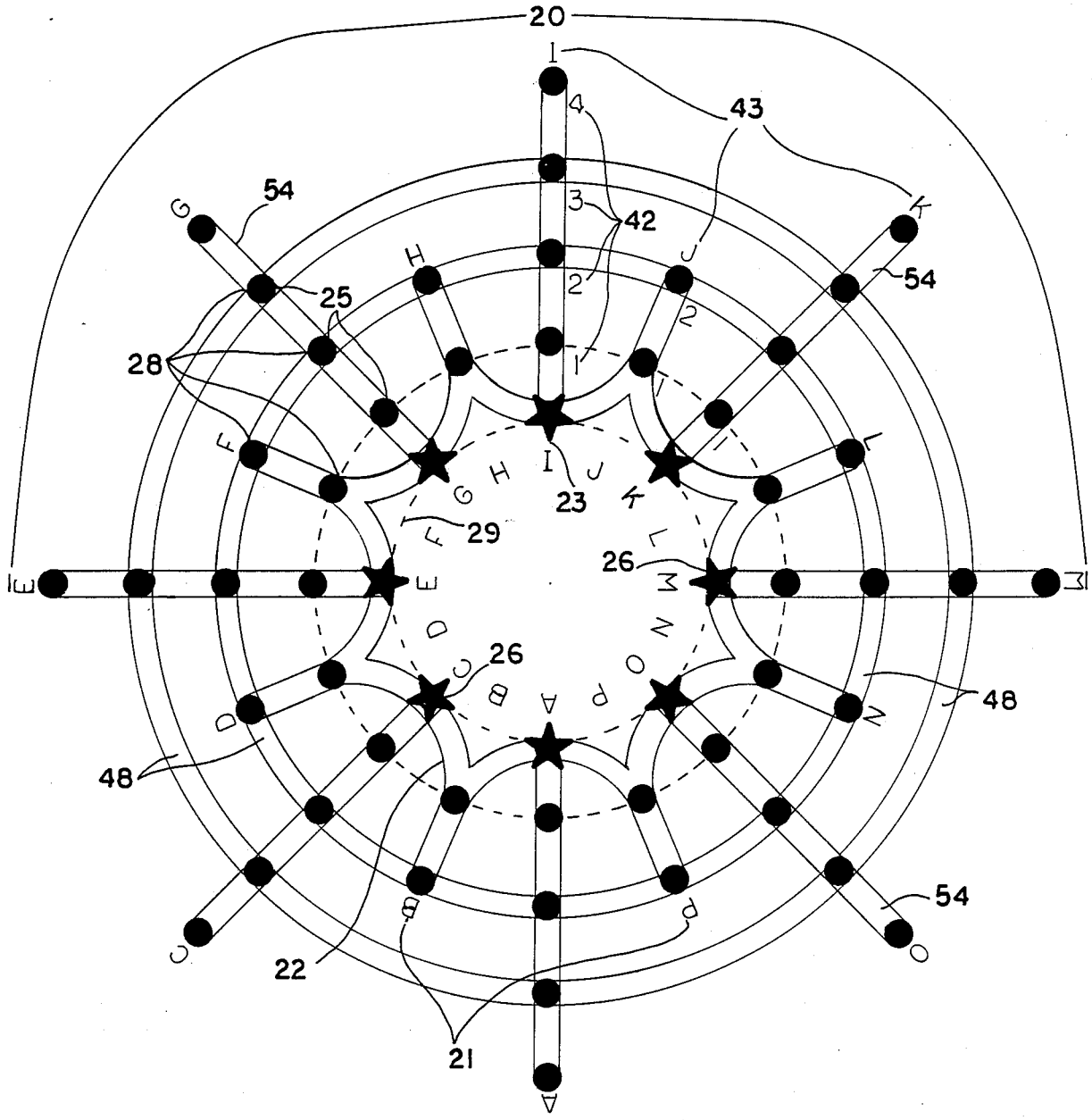
FIG. 2 is a detailed depiction of the moving area depicting the moving path possibilities.

The overall playing area (20) as more completely depicted in FIG. 2, is best considered at being divided into eight equal sections (21), each equal section (21) being generally defined by a U-shaped curve (22), said U-shaped curve (22) having its apex (23) at a point along the inner concentric ring (29). The side (27) of each U-shaped curve (22) shares a common side (27) with each adjacent U-shaped curve (22). Each U-shaped curve (22) is further divided by a straight radial path (54) from an apex outward through the other concentric rings (24). Some of the concentric rings are further defined by marked paths (48).

The points (28) at which each of the concentric rings (24) are crossed by a portion of the U-shaped curve (22) or straight radial path (54) comprises a playing position (25), and the playing position (25) which is at the point at which the apex (23) of the U-shaped curve (22) meets the inner concentrate ring (29) has been marked with a star (26) or other distinctive symbol or color. Each other designated playing position (25) is assigned a starting point designation which is based upon the labeling (42) of its concentric ring (24) and labeling (43) of its path towards the playing position (25) marked with a star (26). In the playing area (20) of the preferred embodiment there are forty-eight such starting positions (28) plus the eight objective, or "starred" positions (25).

Figure 3:
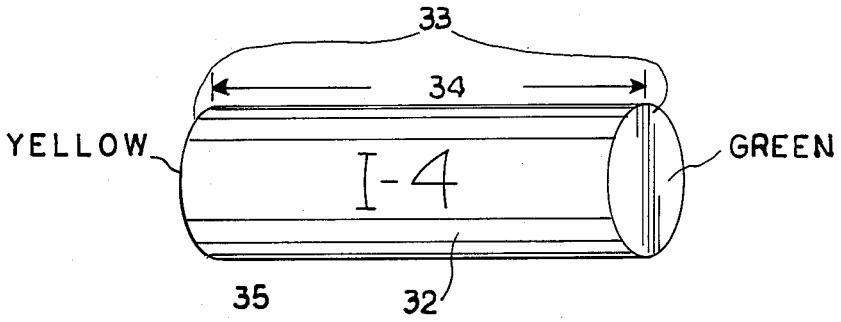
FIG. 3 is a detailed depiction of a piece for moving as well as a "blockade" piece.

Reference is now made to FIG. 3. There are also playing pieces (32) for each designated starting position (32) not marked with a star (26). The playing pieces may be cylindrical with planar, parallel ends (33) which are perpendicular to the length of the cylinder (34) such that the playing piece may be rested upon a flat surface with either end (33) up and fit upon any of the playing positions (25). Each such playing piece (32) is marked with a different corresponding playing position designation (35) and the number of playing pieces is the same as the number of designated starting positions. The opposite ends (36) of each playing piece (32) are colored different colors from each other, but the same color combination is used for each playing piece (32). There are two unmarked playing pieces, which are not separately depicted. They are identical in structure to the playing piece of FIG. 3 but are unmarked and of uniform color. Their use as "blockade" members is described in Exhibit I.

Figure 4:
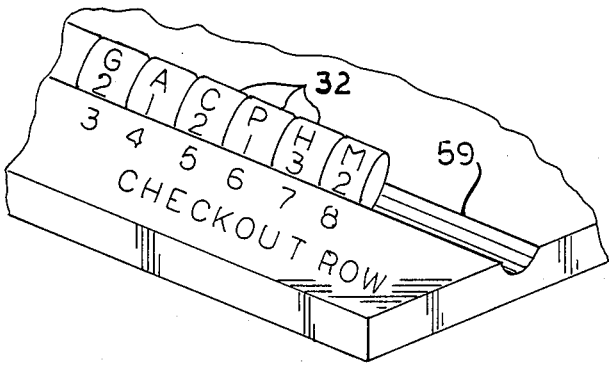
FIG. 4 is an expanded view of the storage areas which may be created facilitating the stability of pieces in their game positions.
Figure 5A:
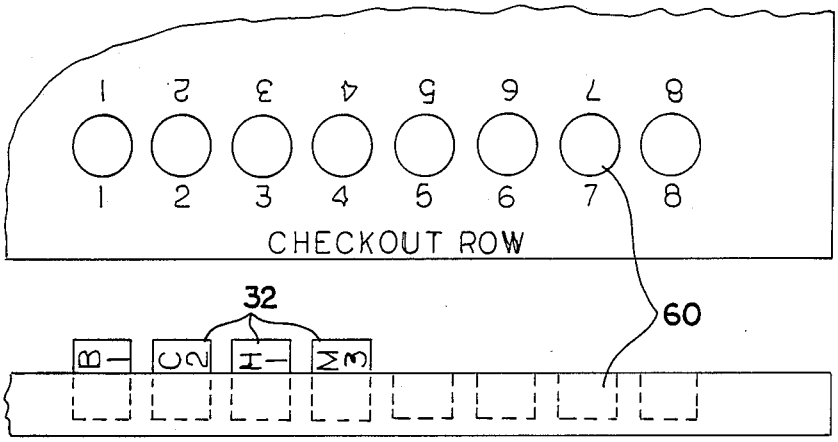
FIGS. 5A and 5B depict alternate versions of storage area.
Figure 5B:
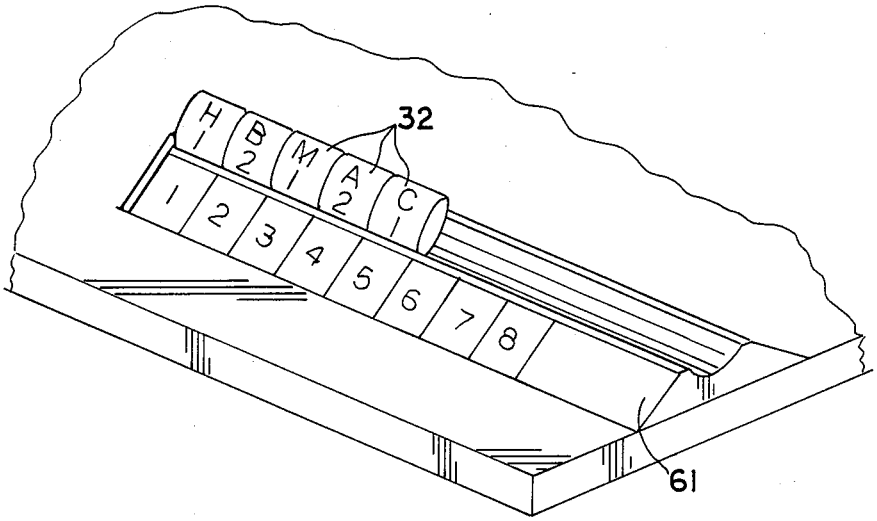

The playing board further comprises four slotted areas (59) for laying the playing pieces (32) out of the playing spaces (25) along the concentric rings (24, 29). An expanded view is provided at FIG. 4. Additionally, this function could be served by using notches (60) as shown in FIG. 5 A, or a slotted removeable member (61) as shown in FIG. 5 B.

Figure 6:
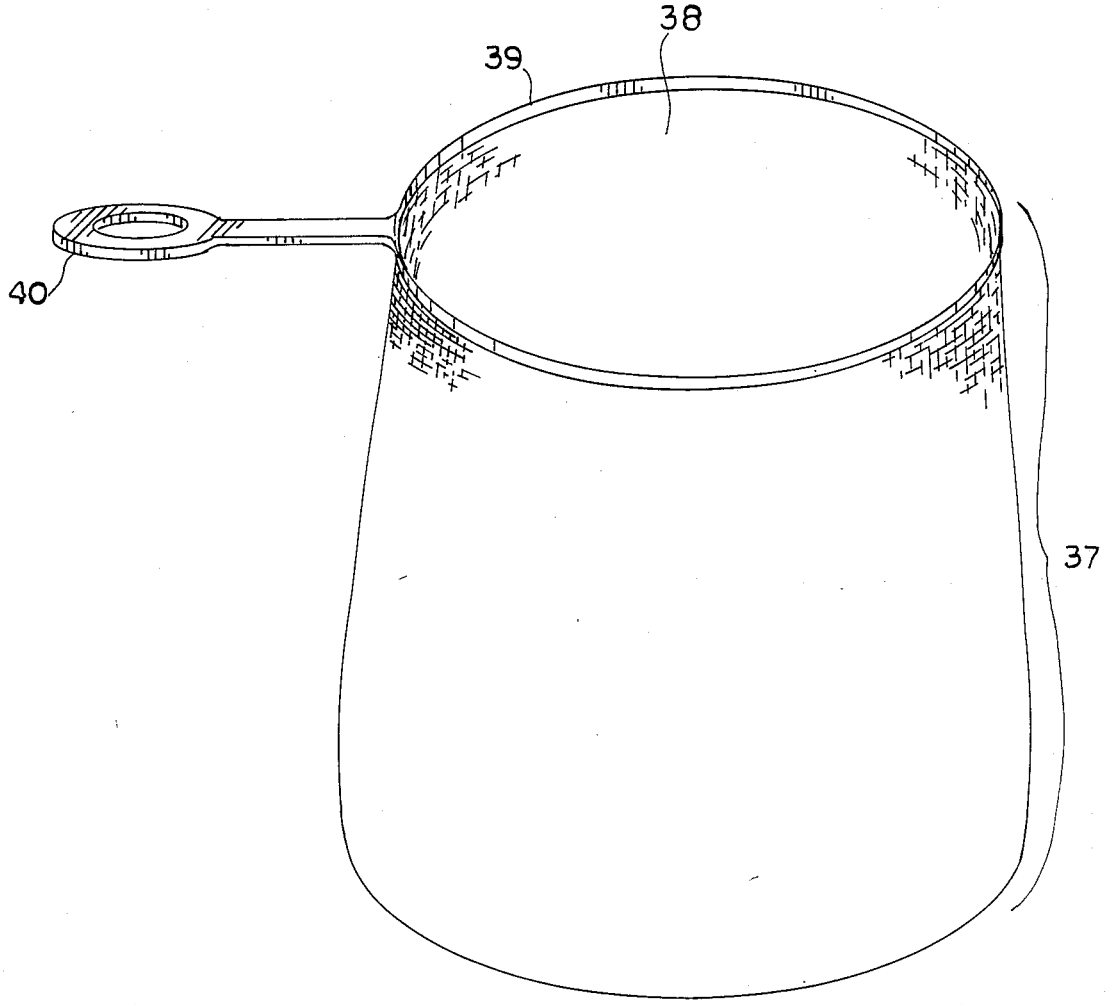
FIG. 6 is a depiction of a bag, which is a possible way of providing a random selection means for determining starting positions.
Figure 6A:
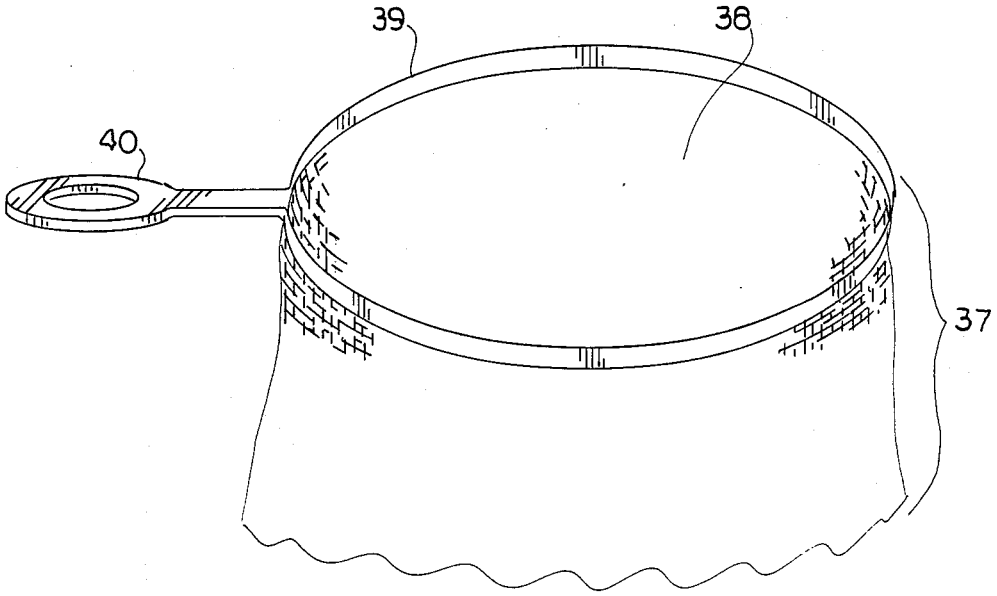

The game apparatus further comprises a container (37) large enough to hold all of the playing pieces (32) and is further adapted to permit the playing pieces (32) to be thoroughly mixed up for random distribution. An example of one possible container is depicted in FIG. 6. Such a container (37) could comprise a bag which could be closed up for mixing the pieces and then opened at an end (38) so that a player could reach into the bag (37) with his hand and pick playing pieces (32) out at random. The bag (37) could further be mounted on a looped wire (39) with a handle (40) as depicted in FIG. 6, with expanded view of FIG. 6A.

The set of rules, which are attached and fully incorporated by this reference, are helpful in understanding the nature of a game which may be played with the apparatus claimed herein. It should be understood, however, that the numbers of playing pieces and playing positions may be adjusted within the scope and spirit of this invention.

Modification and variation can be made to the disclosed embodiments without departing from the subject and spirit of the invention as defined in the following claims. For instance, a box could be used to house the playing pieces for mixing and random distribution. Trays or other storage areas could be used for storage of unused pieces or apparatus. The slotted storage areas of the game board could be replaced by cutout areas to stand the pieces on end or by simply marking places to stand them up. Such modifications and variations, as included within the scope of these claims, are meant to be considered part of the invention as described.

EXHIBIT I

How To Play Checkout

This is a board game for two players of all ages. The rules are easy to learn.

The object of the game is to advance eight pieces to the CHECKOUT row before your opponent does.

There are forty-eight pieces to be placed in the Scramble Bag. Each player takes out twenty pieces. The eight pieces left in the bag will not be used in this game. The pieces have a yellow cap on one end and a green cap on the other. Each player selects a different color then turns his twenty pieces on end and with his color showing. Each player is also allowed one red blockade which is placed on the identified blockade spot.

The pieces are placed on the CHECKOUT board according to their letter and number. The blue paths leading toward the center are lettered A to P. Spots on the blue paths are numbered 1 to 4 as you move away from the center. Eight paths have four spots. Eight paths have only two spots numbered 1 and 2. The star spots are the desired destinations for the pieces and have no numbers.

The flip of a coin decides who moves first. A piece can be moved one spot in any direction where there is a spot open but you must stay on a blue path. If your opponent has a piece on an adjacent spot you may jump over that piece if there is an open spot to land on but you must stay on the blue straight or curved paths and you are not allowed to jump around sharp corners. Each player can jump only one at a time and is limited to a total of five jumps. all pieces jumped are considered captured and must be removed and placed on your capture row.

The idea is to first get pieces to the star spots. when you have a piece that lands on a star spot you can for your next move lift the piece and place it in the CHECKOUT row. If you so desire you may leave this piece on the star spot so as to temporarily block your opponent. When it is your move you may at anytime use your blockade. It may be placed on any open spot on the board. You may replace any opponent's piece with your blockade, but this captured piece must be placed in your captured row. Once the blockade is placed on the board it remains on the spot for the remainder of the game. Putting the blockade on the board does not cost you a move and you now continue with your normal move.

Anytime it is your turn to make your normal move and you have one or more pieces on the star spots and all eight star spots are occupied, then you must remove one of your pieces and place it in your CHECKOUT row. That as explained above counts as a move.

Alternate moves until one player has filled his CHECKOUT row with eight pieces. He is then declared the winner. STRATEGY:

Move only the pieces that you think have a chance to make it to the star spots and CHECKOUT row. Jump your opponent when it helps to save some moves. Don't be in a hurry to use your blockade, but use it wisely.

You can create your own strategy as you gain experience. Each CHECKOUT game is different.

"The more you play the better you play!"

What is claimed is:

1. Apparatus for a board game, the apparatus comprising:

a board which is marked with a pattern for maneuver, said maneuver pattern further comprising three or more concentric rings, the innermost of which is marked at regular intervals with four or more points around its circumference and one or more of the other said concentric rings being connected by a marked circular path;

three diverging paths extending radially out from each said innermost ring point such that one said diverging path extends directly out along the radius of said concentric rings from each said innermost ring point through the other said concentric rings with the other two surrounding diverging paths extending out from each said innermost ring point to one or more other said concentric rings in curved or oblique paths and such that each said curved or oblique path joins with the said curved or oblique path from an adjacent said innermost ring point at another said concentric ring and from said other concentric ring merge together and terminate or alternatively form a common path which extends generally radially outward from said other concentric ring through at least one said surrounding concentric ring;

said innermost ring points being marked in one way and each said point at which any said diverging path intersects a said concentric ring being marked another way;

each said diverging path being marked or labeled with a symbol and each said concentric ring being marked or labeled with another symbol such that each said point of intersection of a diverging path and a concentric ring can be identified by marking reference to the said path symbol and the said concentric ring symbol;

at least one playing piece for each said point of intersection, each said playing piece being marked with the same designation as each said corresponding point of intersection designation and each said playing piece further adapted to rest upon any said point of intersection or any said innermost ring point in a manner so as to display either one color or another color, each said playing piece further being adapted with the same two colors on said ends;

two additional said playing pieces which are of any color and unlabeled and are further adapted to rest upon any said point of intersection or any said innermost ring point; and a containing and mixing chamber into which each said marked playing piece may be enclosed and thoroughly mixed together and from which said mixed marked playing pieces may be randomly distributed.

2. The invention described in claim 1 which is further adapted with four storage means upon said game board such that one or more playing pieces may be stored therein, and that each of two opposite sides of said board has two said storage areas which are identical in size to the two said storage areas on the opposite said side.

3. The invention described in claim 1 in which said containing and mixing vessel is an opaque bag which is further adapted with a mounting means, said mounting means comprising a loop member attached to the mouth of said opaque bag leaving an opening large enough to accomodate a person's hand grasping at least one playing piece;

said loop member being further adapted with a handle, said handle being rigidly attached to and extending outwardly from said loop member.

4. The invention described in claim 2 in which said containing and mixing vessel is an opaque bag which is further adapted with a mounting means, said mounting means comprising a loop member attached to the mouth of said opaque bag leaving an opening large enough to accomodate a person's hand grasping at least one playing piece;

said loop member being further adapted with a handle, said handle being rigidly attached to and extending outwardly from said loop member.

5. A board for a game and related apparatus, said game apparatus comprising;

a generally square-shaped and planar surface, said planar surface having a maneuver area near its center, said maneuver area comprising two or more concentric circles, the inner said concentric circle being marked abouts its circumference at regular intervals with a series of points, said points forming the appex of equal numbered series of U-shaped paths, each U-shaped path generally extending out from said appex points and crossing the remaining said concentric circles;

the said points at which the U-shaped paths cross each said concentric circle being marked as playing positions, each such U-shaped path sharing a common side with each adjacent U-shaped path, each said U-shaped path being bisected with a straight line extending from said appex point out through said concentric circles through the middle of the area enclosed by each U-shaped path, the points at which each such bisecting line intersects with each said concentric circle also being marked as a playing position;

said game board being adapted with two slotted areas on each of two opposite sides of said maneuver area, each said slotted area on each side being adapted to hold a certain number of playing pieces laid on its side such that the two slotted areas on each opposite side of the game board are identical in size to the slotted areas on the other side;

said game apparatus further comprising a number of playing pieces at least equal to the overall number of playing positions less the apex positions;

each said diverging path being marked or labeled with a symbol and each said concentric ring being marked or labeled with another symbol such that each said playing position of a diverging path and a concentric ring can be identified by a marking reference to the said path symbol and the said concentric ring symbol;

at least one playing piece for each said point of intersection, each said playing piece being marked with the same designation as each said corresponding point of intersection designation, each said playing piece being generally of an elongated geometrical configuration such that said playing piece may be laid on its side in any of the said slotted areas, each said playing piece further having two generally planar and parallel ends, which are generally perpendicular to the length of said elongated piece each said end being colored such that the opposite ends of each piece will have different colors and all playing pieces will have one end painted one same color and all playing pieces will have the other end being painted a same other color; and said game apparatus further comprising a container which is large enough for all said playing pieces to be contained within it at the same time, said container further being adapted to permit the playing pieces to be thoroughly mixed together so that playing pieces can be drawn by hand through an opening to said container area.

6. The invention described in claim 5 wherein in the number of U-shaped paths is at least four, the number of concentric rings is at least 3 and the number of playing pieces is at least 16.

7. The invention described in claim 5 in which the number of U-shaped paths is five and the number of playing pieces is at least 24.

8. The invention described in claim 5 in which the number of U-shaped paths is eight, the number of concentric rings is at least three and the number of playing pieces is at least forty-eight.

* * * * *